US011291094B2

(12) United States Patent
Shi et al.

(10) Patent No.: US 11,291,094 B2
(45) Date of Patent: Mar. 29, 2022

(54) LED DRIVING CIRCUIT

(71) Applicant: SIGNIFY HOLDING B.V., Eindhoven (NL)

(72) Inventors: Liang Shi, Shanghai (CN); Jie Fu, Shanghai (CN); Kelvin Wang, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/269,047

(22) PCT Filed: Aug. 12, 2019

(86) PCT No.: PCT/EP2019/071553
§ 371 (c)(1),
(2) Date: Feb. 17, 2021

(87) PCT Pub. No.: WO2020/035436
PCT Pub. Date: Feb. 20, 2020

(65) Prior Publication Data

US 2021/0282242 A1 Sep. 9, 2021

(30) Foreign Application Priority Data

Aug. 17, 2018 (WO) ..... PCT/CN2018/101182
Nov. 5, 2018 (EP) ..... 18204418

(51) Int. Cl.
*H05B 45/36* (2020.01)
*H05B 45/20* (2020.01)
(Continued)

(52) U.S. Cl.
CPC ..... *H05B 45/36* (2020.01); *H05B 45/20* (2020.01); *H05B 45/325* (2020.01); *H05B 45/395* (2020.01)

(58) Field of Classification Search
None
See application file for complete search history.

(56) References Cited

U.S. PATENT DOCUMENTS

2010/0320927 A1 12/2010 Gray et al.
2013/0015781 A1* 1/2013 Kanemitsu ..... G09G 3/3406 315/291
(Continued)

FOREIGN PATENT DOCUMENTS

CN 107094329 A 8/2017
CN 107231719 A 10/2017
(Continued)

*Primary Examiner* — Anh Q Tran
(74) *Attorney, Agent, or Firm* — Daniel J. Piotrowski

(57) ABSTRACT

A LED driving circuit (20) is for driving at least two LED segments (22, 24) of different color or color temperature, using an input current which has a current ripple amplitude. The LED driving circuit (20) comprises an input to receive the input current; an output to connect to the at least two LED segments (22, 24); and a current distributing circuit which provides the input current to a single one of the two LED segments when the current is at a peak portion, wherein the current distributing circuit is adapted, when providing the input current to a single one of the two LED segments during the peak portion, to provide the input current to the single one of the two LED segments alternately, and splits the input current into two non-zero currents for different LED segments when the current is in a trough. When all current is provided to one LED segment, the light conversion efficiency is lower than when two segments are driven with lower current. This means the effect which the current ripple has on the light output is reduced. The driving circuit effectively compensates for the current ripple by adjusting the light conversion efficiency so that a flatter light output characteristic is obtained.

13 Claims, 5 Drawing Sheets

(51) Int. Cl.

| | |
|---|---|
| ***H05B 45/395*** | (2020.01) |
| ***H05B 45/24*** | (2020.01) |
| ***H05B 45/325*** | (2020.01) |

(56) References Cited

U.S. PATENT DOCUMENTS

| | | | | |
|---|---|---|---|---|
| 2014/0333216 | A1* | 11/2014 | Zhang | H05B 45/46 315/185 R |
| 2015/0130861 | A1 | 5/2015 | Lee et al. | |
| 2016/0157318 | A1 | 6/2016 | Yadav et al. | |
| 2016/0323972 | A1* | 11/2016 | Bora | H05B 45/24 |
| 2016/0324916 | A1 | 11/2016 | Lauderdale | |

FOREIGN PATENT DOCUMENTS

| | | | |
|---|---|---|---|
| EP | 0695112 | A1 | 1/1996 |
| WO | 2015193071 | A1 | 12/2015 |
| WO | 2016164928 | A1 | 10/2016 |

* cited by examiner

LED DRIVING CIRCUIT

CROSS-REFERENCE TO PRIOR APPLICATIONS

This application is the U.S. National Phase application under 35 U.S.C. § 371 of International Application No. PCT/EP2019/071553, filed on Aug. 12, 2019, which claims the benefit of International Application No. PCT/CN2018/101182, filed on Aug. 17, 2018 and European Patent Application No. 18204418.0, filed on Nov. 5, 2018. These applications are hereby incorporated by reference herein.

FIELD OF THE INVENTION

This invention relates to LED driving circuits and lighting arrangements using the LED driving circuit.

BACKGROUND OF THE INVENTION

LEDs are increasingly used in current lighting applications, and increasingly low cost LED drivers are available for applying the desired constant drive current to the LEDs.

The output current is not really constant, and there is a trade off between the cost of the driver components and the quality of the current drive signals. There is always a ripple over the average current value.

Based on current standards, a 30% ripple at the (rectified) mains frequency (100 Hz or 120 Hz) is acceptable, and LED drivers are designed to approach this limit of acceptability, in order to limit the driver cost. Especially when the driver is a single stage driver, the PFC requirement of the driver make the ripple at the output hardly avoidable.

However, customer requirements are for increasing light uniformity, especially in professional applications. Thus, the lighting flicker created by a large ripple current (such as a 30% ripple) is becoming unacceptable.

There is therefore a need to reduce the light flicker, resulting from a level of current ripple, but with a minimal cost increase and efficiency penalty.

Color temperature tuning and/or full color control is also becoming increasingly popular. The most economic method to implement color temperature control is to use a single channel driver and simply split the current between two or more LED channels for different color temperature LEDs.

There are two approaches for splitting current between two (or more) LED channels. One approach is to apply pulse width modulation, whereby all current always flows into one LED channel at a time, thus providing a time division approach. The controller simply selects the duty cycle of the current which passes through each LED channel.

The other approach is to tune the currents flowing to the two channels using a linear control mode. The controller selects the current amplitude of each LED channel and the total current corresponds to the LED driver output current.

Both methods pass the current ripple from the LED driver to the lighting load so that the light flicker depends on the LED driver performance. If a smaller amount of flicker is needed, a driver with lower ripple (and hence higher cost) is necessary. If a ripple absorbing circuit is provided, for example within a linear current source circuit, this will cause power loss.

There is therefore is a need for a driver which can reduce the light flicker caused by a current ripple but without requiring a significant increase in cost or power loss.

CN107094329A discloses current splitting into different LEDs, at different total input current amplitude. More specifically, at high input current amplitude, all input current is injected to only one LED; while at a lower input current amplitude, the input current is split and injected to different LEDs simultaneously.

SUMMARY OF THE INVENTION

The invention is defined by the claims.

It is a concept of the invention to use an input current to drive a number of segments of different color or color temperature of an LED circuit in dependence on the instantaneous value of a current ripple at the input. The current is controlled in such a way that the light conversion efficiency is selected according to the instantaneous value of the current ripple, to provide compensation for the current ripple and thereby provide a more constant light output in the presence of a current ripple. More specifically, when the instantaneous value of the current ripple is at a high or peak portion, the current distributing circuit is adapted, when providing the input current to a single one of the two LED segments during the peak portion, to provide all of the input current to the two LED segments alternately and the LED is set to operate in a low output efficiency state; otherwise at a low or valley portion, split the input current into two non-zero currents and provide the two non-zero currents to respective and different LED segments simultaneously, the LED segments are set to operate in a high output efficiency sate. The output efficiency of the LED depends on the input current. Thus by dynamically routing the whole current, the current into LEDs can be changed and the LEDs can be operated at different output efficiency states.

According to examples in accordance with an aspect of the invention, there is provided a LED driving circuit for driving at least two LED segments of different color or color temperature, wherein the driving circuit is adapted to receive an input current with a ripple in amplitude, the input current having a peak portion with a first amplitude above a boundary amplitude in the input current and a valley portion with a second amplitude less than the boundary amplitude, wherein the LED driving circuit comprises an input to receive the input current;

an output to connect to the at least two LED segments (22, 24); and a current distributing circuit which is adapted to:

provide the input current to a single one of the two LED segments during the peak portion; and split the input current into two non-zero currents and provide the two non-zero currents to respective and different LED segments simultaneously during the valley portion;

wherein the current distributing circuit is adapted, when providing the input current to the single one of the two LED segments during the peak portion, to provide the input current to all of the input current to the single one of the two LED segments (22, 24) alternately.

This driving circuit is able to deliver all of the input current received (e.g. from a LED driver) either to one LED segment, or to split the current between the two LED segments. When all current is provided to one LED segment in the peak portion, the light conversion efficiency of that LED segment is lower than when two segments are driven with lower current. This means that the light output is lowered when the input current is provided to one segment compared to when the same current is split among the two segments. As a result, the effect which the current ripple has on the light output intensity is reduced. The opposite applies when the current is split simultaneously to the LED segments during the valley portion: the efficiency is higher at a low operating current for each LED segment, thus the total light output is increased compared to when the same total current is injected to only one LED segment. The driving circuit effectively compensates for the current ripple by adjusting the light conversion efficiency so that a flatter light output characteristic is obtained.

It is noted that the concept may be extended to third or further LED segments.

The peak portion and the valley portion may together cover the full time period. However, there may be a time period between the peak portion and the valley portion (i.e. covering a band either side of the average current). During this average current band, either of the two current distributing methods may be appropriate. Thus, the peak portion and the valley portion may be only those time periods near the maximum and minimum current levels of the rippling input current.

Thus, both LED segments may be used even during the time of the peak portion. The alternating switching frequency will be higher than the frequency of the input current ripple and can be made sufficiently high not to be visually perceived.

The driving circuit may be for driving two LED segments of different color or color temperature, and wherein the current distributing circuit is adapted, when providing the input current to the single one of the two LED segments during the peak portion, to control an alternation time ratio thereby to control an overall output color or color temperature.

Thus, the color output may be controlled as well as providing a more constant light output intensity over time. Two LED segments are often used for color control (in particular color temperature control), so the added feature of more uniform light output over time comes with little additional complexity.

In an embodiment, when providing the input current to the single one of the two LED segments during the peak portion the single one LED segment is set to operate in a first current-to-light conversion efficiency; and when split the input current into two non-zero currents and provide the two non-zero currents to respective and different LED segments simultaneously during the valley portion, the different LED segments are set to operate in a second current-to-light conversion efficiency higher than the first current-to-light conversion efficiency.

The circuit may again be for driving two LED segments of different color or color temperature, and wherein the current distributing circuit is adapted, when splitting the input current into two non-zero currents during the valley portion, to control a current ratio between the two non-zero currents thereby to control an overall output color or color temperature. Thus, different color control approaches are used for the peak and valley times.

The circuit may instead be for driving two LED segments of the same color or color temperature. Thus, the invention is not limited to a lighting circuit with color control. The advantages of compensating for the current ripple apply also to single color lighting systems.

The current distributing circuit may comprise a first switch in series with a first LED segment, a second switch in series with a second LED segment, and a switch controller for controlling the first and second switches. The two segments are preferably in parallel to form two branches, and each branch has a series switch.

The first and second switches for example comprise transistors, such as bipolar transistors or MOSFETs, the switch controller is adapted to control one of the first and second switches in a saturation mode and the other in open mode when the current distribution circuit is providing the input current to a single one of the two LED segments, and the switch controller is adapted to control the first and second switches in a linear mode when the current distribution circuit is splitting the input current into two non-zero currents.

By providing different control modes, a pulse width modulation mode with saturated switches may be used for the peak time period and an analog current control (linear mode) may be used for the valley time period.

A current sensor arrangement may be provided for sensing the current through each LED segment and the total input current, and providing the sensed currents to the switch controller.

This enables the linear mode transistor drive signals to be set, for providing the desired division of current between the two branches, based on a feedback control loop.

The switch controller is for example adapted to detect when the total input current crosses an average value, thereby to detect the peak portion and the valley portion, wherein the boundary amplitude is the average value ($I_{avg}$) of the input current.

The invention also provides a lighting arrangement comprising:

a LED driving circuit as defined above; and said at least two LED segments driven by the LED driving circuit.

The invention also provides a lighting circuit comprising:

a lighting arrangement as defined above; and an LED driver for output a current with the ripple in amplitude to the LED driving circuit as the input current of the LED driving circuit.

The invention also provides a method of driving at least two LED segments of different color or color temperature, comprising:

receiving an input current with a ripple in amplitude, the input current having a peak portion with a first amplitude above a boundary amplitude in the input current and a valley portion with a second amplitude less than the boundary amplitude, distributing the input current by:

providing the input current to a single one of the two LED segments during the peak portion; and splitting the input current into two non-zero currents and providing the two non-zero currents to respective and different LED segments simultaneously during the valley portion.

The method may comprise, when providing the input current to a single one of the two LED segments, providing the full received current to the two LED segments alternately.

The method may then be for driving two LED segments of different color or color temperature, and it may comprise:

when providing the input current to a single one of the two LED segments, controlling an alternation time ratio thereby to control an overall output color or color temperature; and when splitting the input current into two non-zero currents, controlling a current ratio between the two non-zero currents thereby to control the overall output color or color temperature.

The method may be for controlling first and second switches in series with respective LED segments, and it may further comprise:

controlling one of the first and second switches in a saturation mode and the other in open mode when providing the input current to a single one of the two LED segments, and controlling the first and switches in linear mode when splitting the input current into two non-zero currents.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

Figure 1:
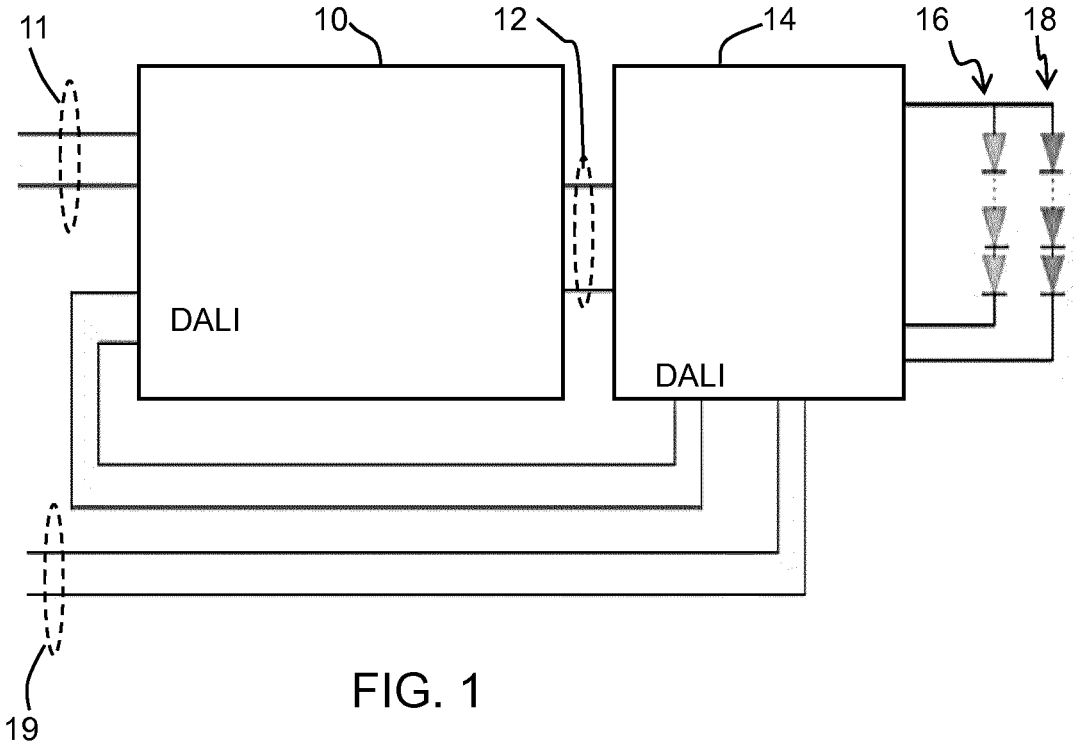
FIG. 1 shows a known driver for implementing color (or color temperature) tuning.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides a LED driving circuit for driving at least two LED segments, using an input current which has a current ripple. The circuit comprises a current distributing circuit which provides the input current to a single one of the two LED segments when the current is at a peak, and splits the input current into two non-zero currents for different LED segments when the current is in a trough. When all current is provided to one LED segment, the light conversion efficiency is lower than when two segments are driven with lower current. This means the effect which the current ripple has on the light output is reduced. The driving circuit effectively compensates for the current ripple by adjusting the light conversion efficiency so that a flatter light output characteristic is obtained.

FIG. 1 shows a known driver for implementing color (or color temperature) tuning There is a main driver 10 which receives a mains input 11 and provides a single channel output current to its output terminals 12. A color control unit 14 delivers an output current to two LED segments 16, 18. The color control unit functions as a DALI master device, and receives DALI input commands 19. It connects to the driver 10 over a DALI interface, and the driver 10 functions as a DALI slave device. The color control unit operates a PWM scheme and thereby delivers the output current from the driver 10 to one or other of the LED segments 16,18.

The color control unit 14 comprises a series switch for each LED segment for implementing the PWM control.

Figure 2:
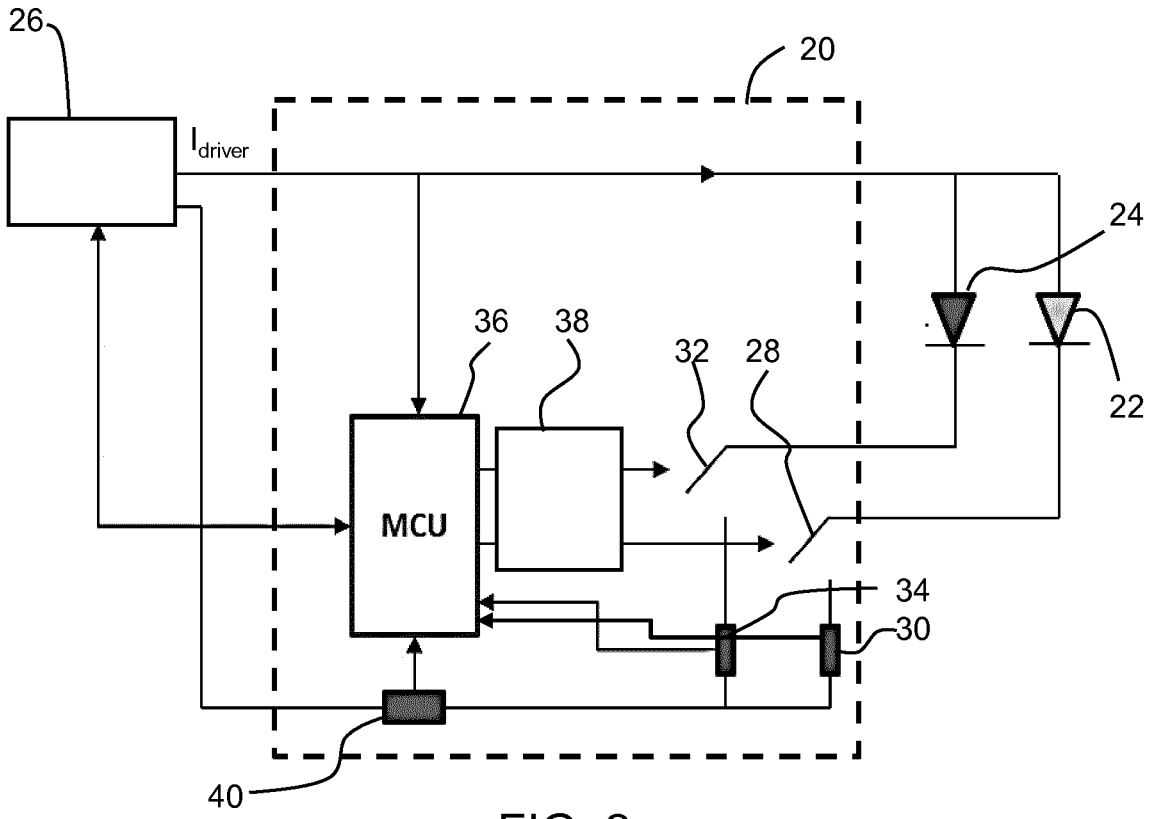
FIG. 2 shows a LED driving circuit for driving at least two LED segments.

FIG. 2 shows a LED driving circuit 20 in accordance with an example of the invention, for driving at least two LED segments 22, 24. Each LED segment is shown schematically as a single diode. However, typically each segment is a series sting of LEDs or it may even be a combination of series and parallel LED branches. The driving circuit 20 receives an input current $I_{driver}$ from a driver 26 with a current ripple. Thus, the driver output current has a peak portion with a first value and a valley portion with a second value less than the first value. The first, peak value is above an average current, which is for example the intended steady state current to be delivered by the driver, and the second, valley value is below the average value. Note that, the peak portion and valley portion are defined just to differentiate from each other in terms of large and small amplitude. A portion with an amplitude higher than the other portion can be considered to be a peak portion while the other can be considered to be a valley portion. The average value of whole current is not necessarily the boundary between the peak portion and the valley portion. For example, assuming the ripple to be sinusoidal waveform from 0 to $2\pi$, the period 0 to $\pi$ could be considered to be a peak portion with respect to the period $\pi$ to $2\pi$ as the valley portion so that the average value is the boundary. However, instead, the period $\frac{1}{4}\pi$ to $\frac{3}{4}\pi$ can also be considered to be the peak portion and the remainder the valley portion so that the average value is not the boundary.

The first LED segment 22 has a first series switch 28 which connects to the low voltage rail through a first current sense resistor 30, and the second LED segment 24 has a second series switch 32 which connects to the low voltage rail through a second current sense resistor 34.

As explained below, these current sense resistors are used for feedback control of the switches 28, 32 when operating in a linear mode.

A switch controller 36 is provided for controlling the first and second switches 28, 32. In this way, two parallel branches are formed, each comprising an LED segment, a series switch and a current sense resistor. The first and second switches 28, 32 comprise transistors such as field effect transistors (FETs), and a FET gate driver circuit 38 is provided for controlling the gate signals applied to the transistors based on instructions provided by the switch controller 36.

A third current sense resistor 40 enables the total current drawn from the driver 26 to be measured. This current is the sum of the currents through the two branches, so that only two current sensing measurements are needed, and the third can instead be derived from the other two.

By monitoring the total current, the current ripple present in the current waveform received from the driver can be monitored. In this way, the switch controller 36 is able to determine if the current is at a peak portion or at a valley portion.

The switch controller 36, FET driver 38 and switches 28,32 together define a current distributing circuit. The current distributing circuit provides the input current to a single one of the two LED segments 22, 24 at all times during the peak portion, and splits the input current into two non-zero currents and provides the two non-zero currents to respective and different LED segments simultaneously at all times during the valley portion.

The driving circuit in this way delivers all of the input current received from the LED driver either to one LED segment, or it splits the current between the two LED segments.

When providing all the input current to one LED segment only, the corresponding switch is closed in a lowest impedance (saturated) state, and the other in a highest impedance (open circuit) state. In order to split the current, the first and second transistors are controlled in a linear mode, providing analog control of the two currents, wherein the total current is constrained to be the current delivered by the driver. Thus, the analog control implements a desired current splitting ratio.

In this way, a pulse width modulation mode is used with saturated switches for the peak time period and a linear analog current control is used for the valley time period.

Figure 3:
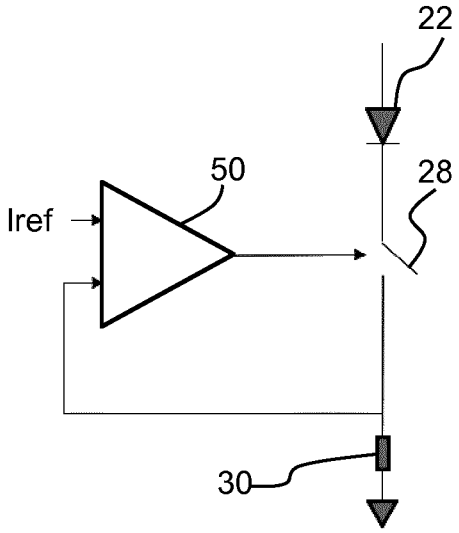
FIG. 3 shows an example of one FET driver circuit.

FIG. 3 shows an example of one FET driver circuit, for the transistor 28 of the first LED segment 22. A current reference Iref (encoded as a voltage level) is provided to a comparator circuit 50. The comparator circuit also receives the measured current (again as a voltage level) from the current sense resistor 30. Thus a feedback control system is used to regulate the output current based on the gate control signal applied to the transistor in its linear control region.

Figure 4:
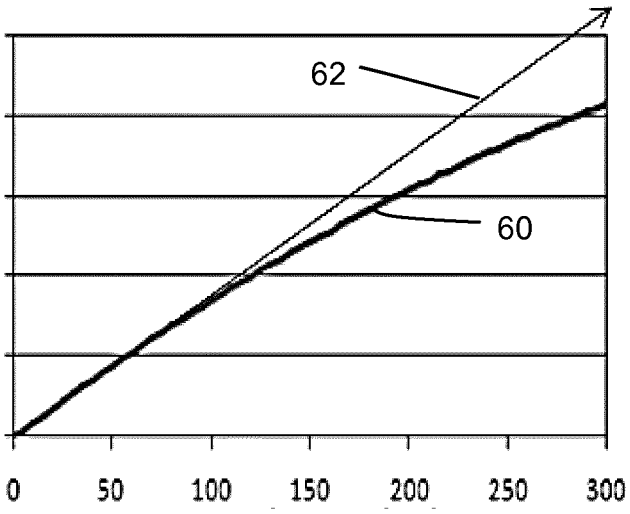
FIG. 4 shows the typical relationship between the relative light output intensity (y-axis, arbitrary units) and the forward current (x-axis, mA)

FIG. 4 shows the typical relationship between the relative light output intensity (y-axis, arbitrary units) and the forward current (x-axis, mA). The plot 60 deviates from a linear path 62 because the light conversion efficiency is lower at higher currents.

Thus, when all current is provided to one LED segment, the overall light conversion efficiency is lower than when two segments are driven with lower currents. This means that the light output is lower when the input current is provided to one segment than when the same current is split among two or more segments. As a result, the effect which the current ripple has on the light output intensity is reduced. The driving circuit effectively compensates for the current ripple by adjusting the light conversion efficiency so that a flatter light output characteristic is obtained.

Figure 5:
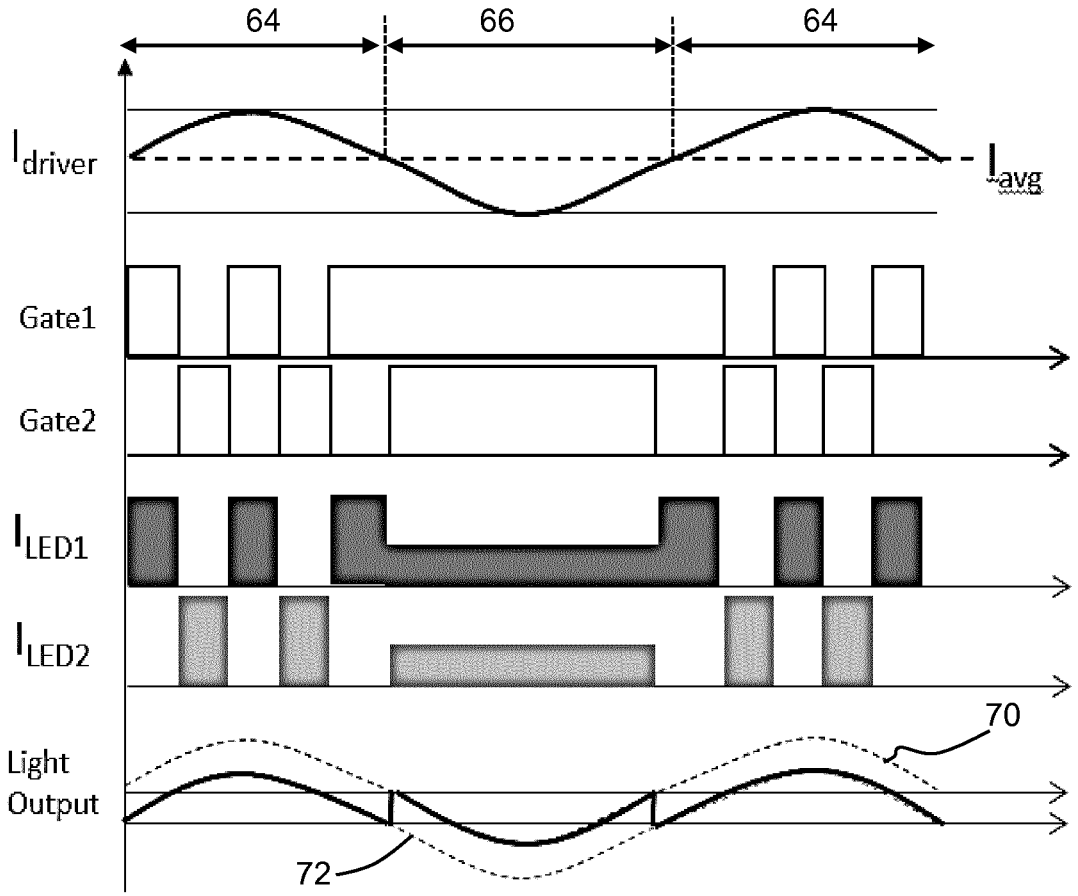
FIG. 5 shows waveforms to illustrate the operation of the circuit of the invention.

FIG. 5 shows waveforms to illustrate the operation of the circuit of FIG. 2.

The top plot shows the current $I_{driver}$, supplied by the driver 26. It comprises peak portions 64 above the average value $I_{avg}$ and valley portions 66 below the average value. The peak portions include a first value which is the maximum current and the valley portions include a second value which is the minimum current. The average value is the DC component of the output current and is the static driver output current level which the driver is aiming to deliver. The current ripple is an undesired additional component resulting from the driver circuit, for example resulting from the use of a simple circuit or low cost components with high tolerance values.

The second plot shows the gate drive signal Gate1 for the first transistor 28 and the third plot shows the gate drive signal Gate2 for the second transistor 32.

During the peak portions 64, the two gate drive signals are complementary, i.e. they alternate in time between a full-on (lowest impedance saturated drive condition) and a full-off (open circuit maximum impedance) state. This is open loop control requiring no feedback regulation. Both LED segments are used during this time. The alternating switching frequency is higher than the frequency of the input current ripple and can be made sufficiently high not to be visually perceived.

During the valley portions 66, the two gate drive signals are both on, and at the same or different analog levels (not shown). The analog drive levels are controlled by a feedback mechanism as explained above, providing closed loop control.

Figure 6:
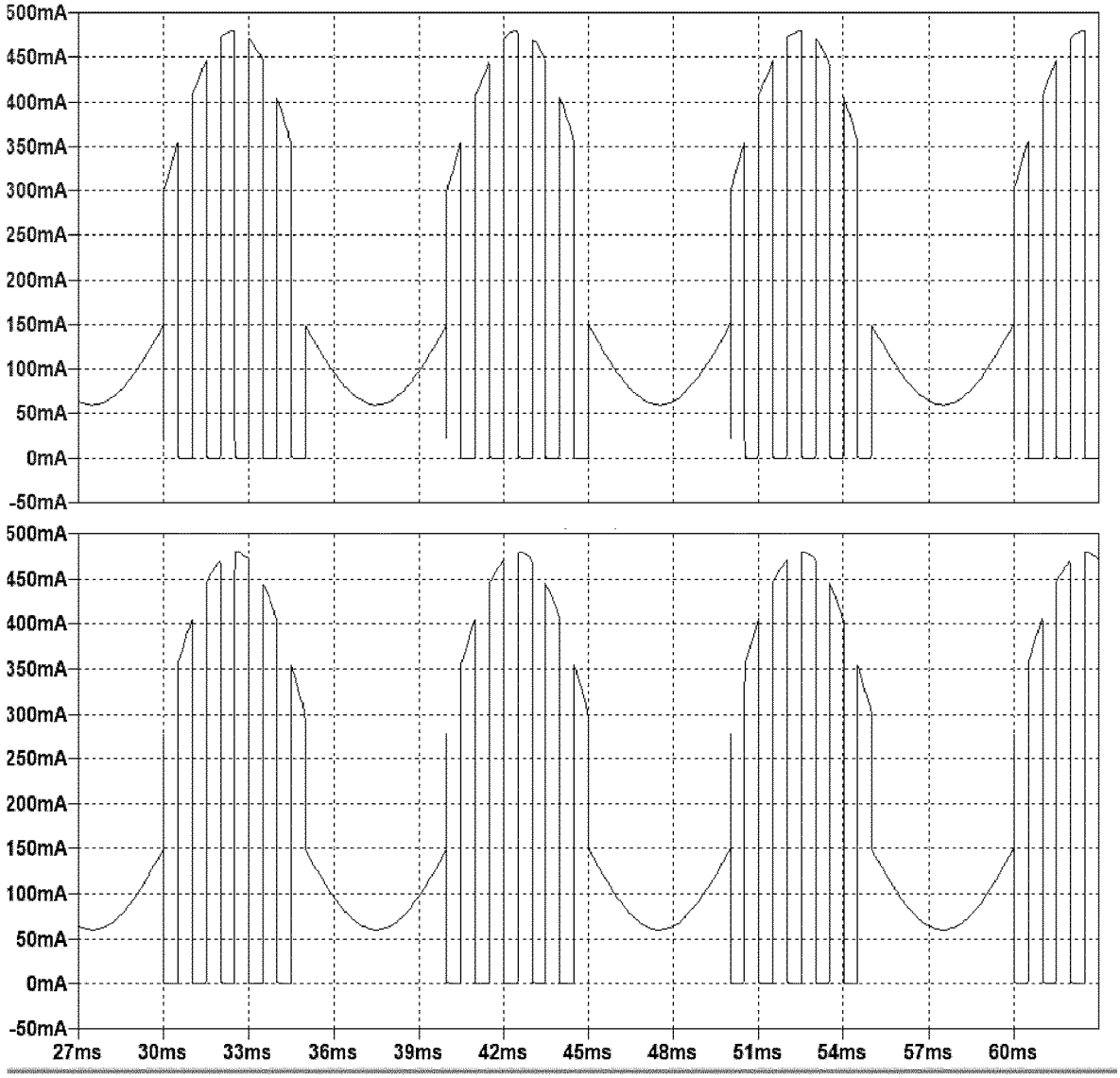
FIG. 6 shows in more detail a current through the two LED segments in the peak portion and in the valley portion.

The fourth plot shows the resulting current $I_{LED1}$ provided to the first LED segment 22. The fifth plot shows the resulting current $I_{LED2}$ provided to the second LED segment 24. These plots show the reduced currents through both LED segments (but delivered at the same time) during the valley portion. Note that these plots are only schematic for showing timings only. More representative current plots are shown in FIG. 6.

The bottom plot shows the light output intensity. The resulting current comprises portions from two waveforms. The first waveform 70 is the linear mode light output intensity waveform which results from splitting the current. The second waveform 72 is the PWM mode light output intensity waveform which results from alternately driving the two LED segments using the full available current. Each of first and second waveforms 70 and 72 substantially follows the waveform of the ripple of the current, and the first waveform 70 is always higher than 72 due to the higher light conversion efficiency.

The embodiment of the invention selects the low efficiency waveform at the peak portion and selects the high efficiency waveform at the valley portion, thus the deviance between the output light intensity levels is reduced. The switching between the two modes takes place based on detecting when the total input current crosses the average value, thereby to detect the peak portion and the valley portion. However, the mode selection may be more complicated, for example having some hysteresis to prevent rapid oscillation between the modes. For example, the peak portion may be detected based on a current threshold higher than the average current and the valley portion may be detected based on a current threshold lower than the average current. Thus, for currents within a band around the average value (which may be considered to be a hysteresis band), either mode may be used. The mode selection is clearly most important at the minimum and maximum current values.

FIG. 5 is based on a desired current split of 50% for each channel, simply as an example which is easy to illustrate.

If $I_{driver}>I_{avg}$, then $I_{LED1}+I_{LED2}=I_{driver}$

In this case the driver is working in PWM mode. The efficiency of the LEDs is low such that the output is limited to waveform 72, not as high as waveform 70.

If $I_{driver}<I_{avg}$, then $I_{LED1}+I_{LED2}=I_{driver}$.

In this case the driver is working in a linear mode. Both LED segments work at higher efficiency leading to higher light output as waveform 70 such that the output is not as low as waveform 72.

The curve in thick solid black line shows the light output according to this embodiment of the invention.

For the same average current, the LED light output is different between the two modes and the peak to peak light output intensity is significantly reduced compared with either individual waveform 70, 72.

FIG. 6 shows the current waveforms of each of two LED segments in more detail than in FIG. 5.

The top waveform is for LED 24 and the bottom waveform is for LED 22.

The LED segments work in a PWM mode when $I_{driver}>I_{avg}$ and are switched to a continuous mode for the rest of time.

The PWM mode is the pulsed portions (at 33 ms to 35 ms, 40 ms to 45 ms, etc.). They are complementary signals, i.e. out of phase with each other so that only one signal is non-zero at a time. The lms period for the PWM signal is used as an example, corresponding to a 1 kHz frequency. The continuous mode is when both current waveforms are positive at the same time. The ripple is shown with a 100 Hz frequency (a 10 ms period).

An experiment has been conducted based on a 10 W 300 mA constant current source with a large ripple (a peak to average ripple of 60% for demonstration purposes) to drive two 30V LED segments. The SVM (Stroboscopic Effect Visibility Measure) dropped from a value of 2 for a PWM distribution of current at all times to a value below 1 based on the approach of the invention.

The two LED segments typically have different color temperatures (e.g. blueish white and yellowish white) or different colors. When providing the input current to a single one of the two LED segments during the peak portion, the alternation time ratio (i.e. the ratio of on times of the two segments) may be controlled thereby to control an overall output color or color temperature. Similarly, the current ratio between the two LED segments may be controlled in the valley portion, to achieve a desired light output color or color temperature.

The circuit may instead be for driving two LED segments of the same color or color temperature. Thus, the invention is not limited to lighting circuit with color control. The advantages of compensating for the current ripple apply also to single color lighting systems.

The switch controller 36 may comprise a digital integrated circuit (microcontroller) but it may also be implemented by an analog circuit.

Figure 7:
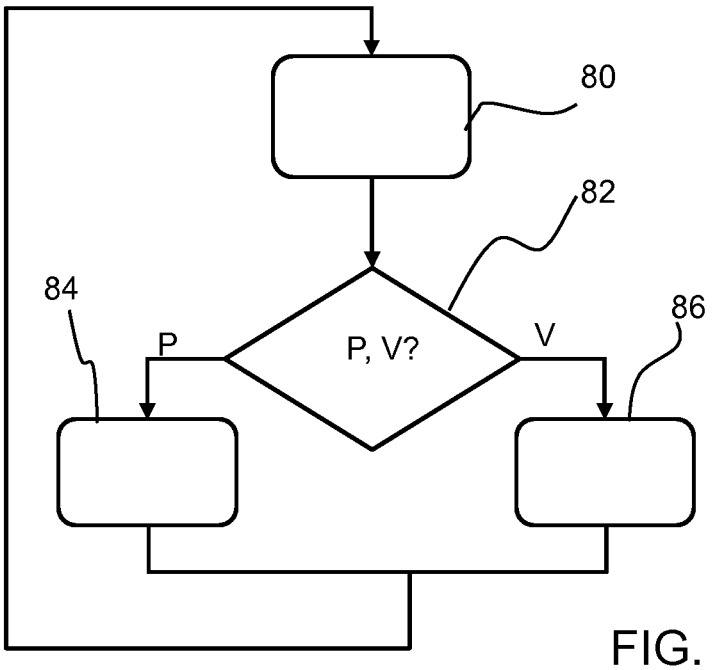
FIG. 7 shows a method of driving at least two LED segments.

FIG. 7 shows a method of driving at least two LED segments. The method comprises in step 80 receiving an input current with a ripple, the input current having a peak portion and a valley portion.

In step 82, the peak portion (P) and the valley portion (V) are detected. The input current is then distributed.

During the peak portion, the input current is provided to a single one of the two LED segments in step 84. The full current is provided to the two LED segments alternately. An alternation time ratio may also be selected thereby to control an overall output color or color temperature.

During the valley portion, the input current is split into two non-zero currents and they are provided to respective and different LED segments simultaneously in step 86. A current ratio between the two non-zero currents may also be controlled thereby to control the overall output color or color temperature.

The invention may be applied to lighting arrangements with more than two segments. The circuit shown is only one example. Other circuit implementations are of course possible to implement the underlying concept, which is to switch between modes, wherein different numbers of LED segments are driven in the different modes, in dependence on the input current ripple.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A LED driving circuit for driving at least two LED segments of different color or color temperature, wherein the driving circuit is adapted to receive an input current with a ripple in amplitude, the input current having a peak portion with a first amplitude above a boundary amplitude in the input current and a valley portion with a second amplitude less than the boundary amplitude, wherein the LED driving circuit comprises an input to receive the input current;

an output to connect to the at least two LED segments; and a current distributing circuit which is adapted to:

provide all of the input current to one and the other one of the two LED segments alternately, during the peak portion, wherein each one LED segment is with in a first current-to-light conversion efficiency at the peak portion; and split the input current into two non-zero currents and provide the two non-zero currents to respective and different LED segments simultaneously during the valley portion while each LED segment, when receiving the split input current, is with a second current-to-light conversion efficiency higher than the first current-to-light conversion efficiency.

2. A LED driving circuit as claimed in claim 1, wherein the current distributing circuit is adapted, when providing the input current to the one and the other one of the two LED segments alternately, during the peak portion, to control an alternation time ratio thereby to control an overall output color or color temperature.

3. A LED driving circuit as claimed in claim 1, wherein the current distributing circuit is adapted, when splitting the input current into two non-zero currents during the valley portion, to control a current ratio between the two non-zero currents thereby to control an overall output color or color temperature.

4. A LED driving circuit as claimed in claim 1, wherein the current distributing circuit comprises a first switch in series with a first LED segment, a second switch in series with a second LED segment, and a switch controller for controlling the first and second switches.

5. A LED driving circuit as claimed in claim 4, wherein the current distributing circuit further comprises a gate driver to drive the first and second switches.

6. A LED driving circuit as claimed in claim 5, wherein the first and second switches comprise transistors, the switch controller is adapted to control one of the first and second switches in a saturation mode and the other in open mode when the current distribution circuit is providing the input current to a single one of the two LED segments, and the switch controller (36) is adapted to control the first and second switches in a linear mode when the current distribution circuit (28, 32, 36, 38) is splitting the input current into two non-zero currents.

7. A LED driving circuit as claimed in claim 5, comprising a current sensor arrangement for sensing the current through each LED segment and the total input current, and providing the sensed currents to the switch controller.

8. A LED driving circuit as claimed in claim 7, wherein the switch controller is adapted to detect when the total input current crosses an average value ($I_{avg}$), thereby to detect the peak portion and the valley portion, wherein the boundary amplitude is the average value ($I_{avg}$) of the input current.

9. A lighting arrangement comprising:

a LED driving circuit as claimed in claim 1; and said at least two LED segments driven by the LED driving circuit.

10. A lighting circuit comprising:

a lighting arrangement as claimed in claim 9; and an LED driver for outputting a current with the ripple in amplitude to the LED driving circuit as the input current of the LED driving circuit.

11. A method of driving at least two LED segments of different color or color temperature, comprising:

receiving an input current with a ripple in amplitude, the input current having a peak portion with a first amplitude above a boundary amplitude in the input current and a valley portion with a second amplitude less than the boundary amplitude, distributing the input current by:

providing the input current to one and the other one of the two LED segments alternately, during the peak portion, while each LED segment is with in a first current-to-light conversion efficiency at the peak portion; and splitting the input current into two non-zero currents and providing the two non-zero currents to respective and different LED segments simultaneously, during the valley portion, while each LED segment, when receiving the split input current, is with a second current-to-light conversion efficiency higher than the first current-to-light conversion efficiency.

12. A method as claimed in claim 11, comprising:

when providing the input current to the one and the other one of the two LED segments alternately, controlling an alternation time ratio thereby to control an overall output color or color temperature; and when splitting the input current into two non-zero currents, controlling a current ratio between the two non-zero currents thereby to control the overall output color or color temperature.

13. A method as claimed in claim 11, comprising controlling first and second switches in series with respective LED segments, comprising:

controlling one of the first and second switches in a saturation mode and the other in open mode when providing the input current to a single one of the two LED segments, and controlling the first and switches in linear mode when splitting the input current into two non-zero currents.

* * * * *